United States Patent [19]

Thompson et al.

[11] 4,303,082

[45] Dec. 1, 1981

[54] MANUALLY OPERATED CIGARETTE MAKING MACHINE

[75] Inventors: David K. Thompson; David Crisp, both of London, England

[73] Assignee: Rizla Limited, Glamorganshire, Wales

[21] Appl. No.: 971,104

[22] Filed: Dec. 19, 1978

[30] Foreign Application Priority Data

Dec. 21, 1977 [GB] United Kingdom ..... 53244/77

[51] Int. Cl.[3] ..... A24C 5/40; A24C 5/42

[52] U.S. Cl. ..... 131/75; 131/70

[58] Field of Search ..... 131/70–75, 131/170 R; 30/113

[56] References Cited

U.S. PATENT DOCUMENTS

| | | | |
|---|---|---|---|
| 1,166,881 | 1/1916 | Anderson | 30/113 |
| 3,721,248 | 3/1973 | Paynter | 131/72 |
| 3,732,873 | 5/1973 | O'Rear | 131/70 |
| 3,783,882 | 1/1974 | Messner et al. | 131/70 |

FOREIGN PATENT DOCUMENTS

| | | | |
|---|---|---|---|
| 651583 | 11/1962 | Canada | 131/70 |
| 379088 | 10/1907 | France | 131/70 |
| 1250856 | 10/1971 | United Kingdom | 131/70 |

*Primary Examiner*—V. Millin

*Attorney, Agent, or Firm*—Wender, Murase & White

[57] ABSTRACT

A manually operated machine is provided for compressing a charge of tobacco into a cylindrical shape and inserting the compressed charge into a preformed cigarette tube. It comprises a body having a nozzle for supporting the cigarette tube, a sliding compression member directly connected to an operating handle, and an ejector such as a tobacco spoon and ejection plug for injecting the cylindrical charge of tobacco through the nozzle into the cigarette tube. The ejector cooperates with a back edge of a tobacco insertion slot, which is directed at a small acute angle thereto, to exert a scissors-like cutting action on protruding strands of tobacco whereby there is produced a clean separation of the charge of tobacco to be compressed.

2 Claims, 8 Drawing Figures

MANUALLY OPERATED CIGARETTE MAKING MACHINE

FIELD OF THE INVENTION

The present invention relates to a machine for manually filling preformed paper cigarette tubes with tobacco.

DESCRIPTION OF THE PRIOR ART

Manually operated cigarette making apparatus of the above type falls into two broad categories. In the simpler kind of machines described, for example, in U.K. Pat. Nos. 340,841, 507,125 and 1,289,563 the user directly compresses the charge of tobacco into a cylindrical plug which is injected into the cigarette tube. More elaborate machines are available in which at least the compression operation is mechanically assisted and examples of such machines are described in U.K. Pat. Nos. 253,652, 464,948 and 1,321,015.

U.K. Patent No. 1,335,640 describes a machine of the mechanically assisted kind, in which a housing includes a tobacco compression chamber and a transversely slidable compression member actuated by an operating handle via a toggle lever system. Tobacco is fed into the compression chamber via a longitudinal slit in the housing, but no mention is made of the compression member cutting off protruding strands of tobacco as it passes the slit during its travel to the fully compressed position and it does not appear that the machine described in the above specification works in this way because the drawings show the compression member to be a clearance fit in the tobacco compression chamber. In consequence a clearly separated charge of tobacco is not obtained and the protruding strands interfere with both the compression and the subsequent injection operations.

SUMMARY OF THE INVENTION

It is an object of the invention to provide a simple cigarette making machine for manually filling preformed paper tubes which works directly rather than with mechanical assistance, in which low operating forces are required and which reproducibly gives cigarettes of good appearance. It is a further object of the invention to provide a manually operated cigarette making machine in which a clean separation of the charge of tobacco is achieved before completion of the compression stroke.

Broadly stated the invention provides a manually operated cigarette making machine comprising in combination:

an elongate body having an internal groove including a first semi-cylindrical face directed longitudinally of said body;

a compression member slidable in said groove and having a front end profiled to define a second semi-cylindrical face, and a first operating handle directly connected to said compression member for moving said compression member transversely between a first position in which said first and second semi-cylindrical faces are spaced apart to define with adjoining regions of said body a tobacco receiving chamber and a second position in which said semi-cylindrical faces abut to define a cavity for compressed tobacco;

a nozzle projecting from said body and communicating with said cavity for supporting a preformed cigarette tube;

means for ejecting a charge of compressed tobacco from said cavity through said nozzle into said cigarette tube;

portions of a top face of said body defining a tobacco insertion slot communication with said tobacco receiving chamber when said compression member is in said first position, and having a back edge directed generally parallel to the axis of said cavity but at a small acute angle relative to the top front edge of said compression member so that as said edge of said compression member travels past said back edge of said slot during travel of said compression member from said first to said second position it exerts a scissor-like cutting action on strands of tobacco projecting from said tobacco receiving chamber into said slot.

Other objects of the invention will become apparent from the following more detailed description of a preferred embodiment.

BRIEF DESCRIPTION OF THE DRAWINGS

An embodiment of the invention will now be described by way of example only with reference to the accompanying drawings in which.

DESCRIPTION OF THE PREFERRED EMBODIMENT

Figure 1:
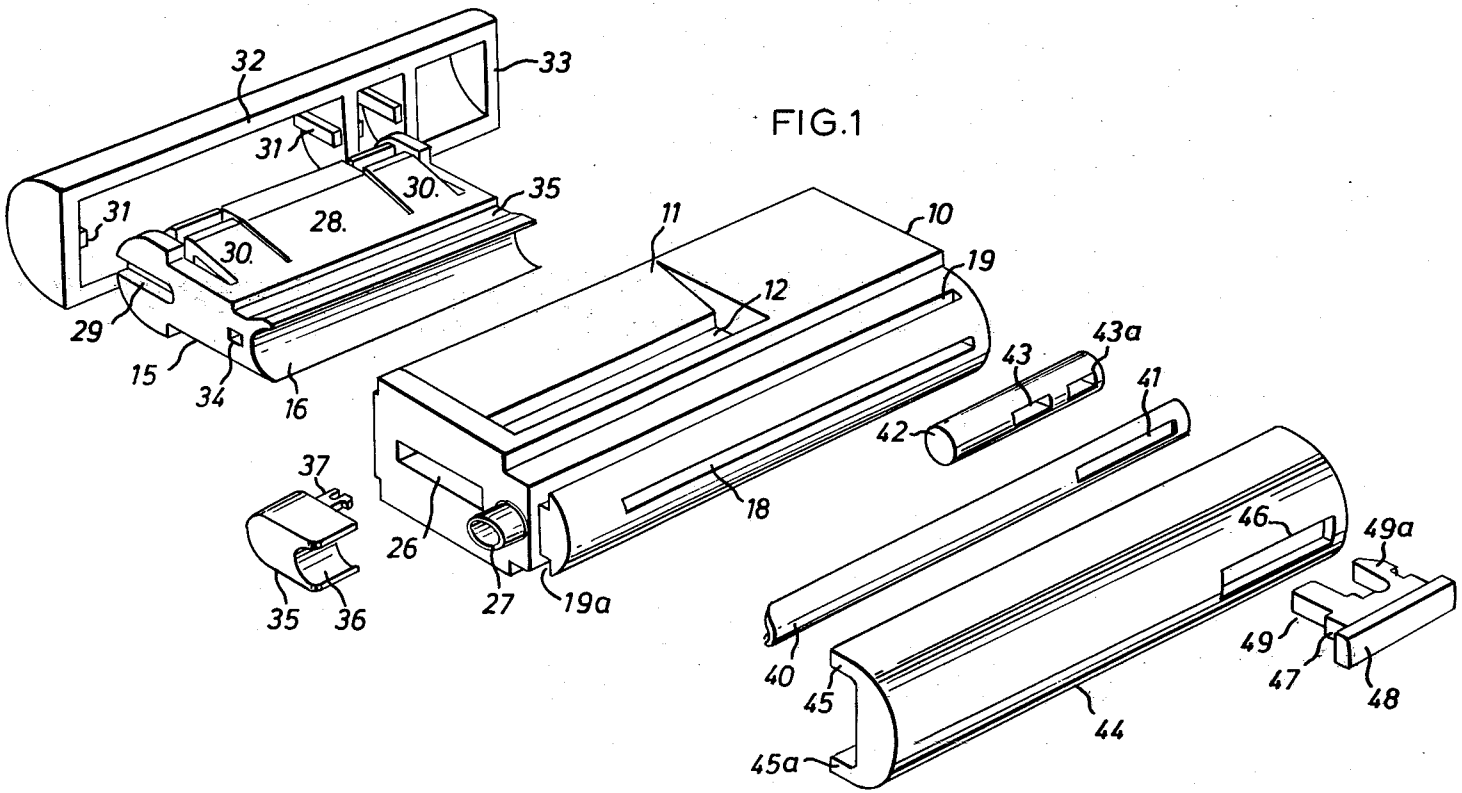
FIG. 1 is an exploded respective view of a preferred embodiment of a hand operated cigarette making machine according to the present invention.

The present machine enables a plug of compressed tobacco to be injected into a preformed paper cigarette tube. It includes a body 10 having at one end a nozzle 27 for supporting the cigarette tube and a sliding compression member directly connected to an operating handle 33 and cooperating with portions of the body, as will be described below, to define a cylindrical cavity for a charge of compressed tobacco. A tobacco spoon 40 and injector plug 42 slidable within the body can be operated by means of a handle to inject the charge of tobacco 44 into the cigarette tube. As will be explained more fully below, as the leading edge of the compression member 15 passes the back edge 51 (FIG. 6) of a tobacco insertion slot 12 in the top of the body 10, which is directed at a small acute angle relative thereto, a scissor-like cutting action is exerted on strands of tobacco protruding into the slot 12 whereby a clean separation of the charge of tobacco to be compressed into a cylindrical plug can be achieved and effective and reliable operation cna be attained.

Figure 3:
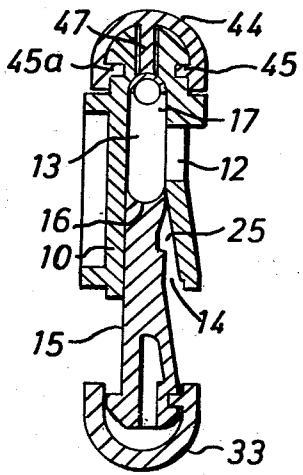
FIG. 3 is a transverse sectional view through the machine of FIG. 1 with the tobacco compressor in the filling position.

Referring to FIGS. 1 and 3, the body 10 of the machine is generally rectangular in plan and has a transverse groove opening to a first side edge and constituted by a tobacco receiving chamber 13 (FIG. 3) having at its inner end 17 a longitudinally directed concave semi-cylindrical end face and at its outer end a divergent mouth region 14. The semi-cylindrical end face is near the second side edge of the body which is formed with a land of arcuate or semi-cylindrical profile which is bounded by opposed longitudinal grooves 19 and 19A in top and bottom faces of the body. A longitudinal slot 18 through the land opens through the semi-cylindrical inner end face into the chamber 13. The top face of the body is formed with a downwardly directed tobacco receiving ledge 11 terminating in a relatively narrow rectangular tobacco insertion slot 12 opening at its lower end into the tobacco receiving chamber 13 at a position slightly spaced transversely from the inner end of the chamber 13. The front end face of the body is formed with a nozzle 27 coaxial with the semi-cylindrical end face and communicating with the chamber 13. A slot 26 also formed on the front face on the nearer side of the nozzle 27 to the first side edge of the body opens into the chamber 13.

A compression member 15 is a sliding fit within the chamber 13 and has a concave semi-cylindrical front end face 16. A longitudinal waste vent groove 25 is formed in the top face of the member 15 in spaced parallel position behind the top front edge thereof. As is most clearly apparent from FIG. 6, the top edge of the end face 16 and the back edge 51 of the tobacco insertion slot 12 are relatively inclined at a small acute angle, and said edges are arranged to cooperate so that as the end face 16 passes the edge 51 the said edges exert a scissor-like cutting action on strands of tobacco protruding from the chamber 13, some of the cut strands passing into the waste vent groove 25. The back end 28 of the member 15 is divergent and is complementary to the mouth region 14 of the tobacco receiving chamber 13. It has guide slots 29 and resilient hooks 30 which respectively engage guide members 31 and a longitudinal retaining flange 32 of a handle 33 which is directly connected to the compression member. A side edge of the compression member has a hole 34 which when the compression member is assembled to the body registers with the slot 26 in the front end of the body.

Figure 2:
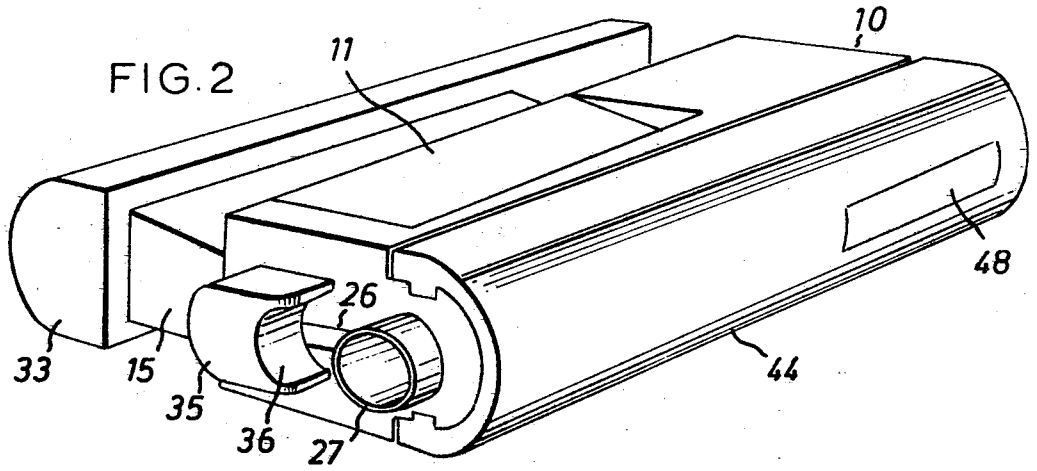
FIG. 2 is a perspective view of the front end and one side of the cigarette making machine shown in FIG. 1.
Figure 4:
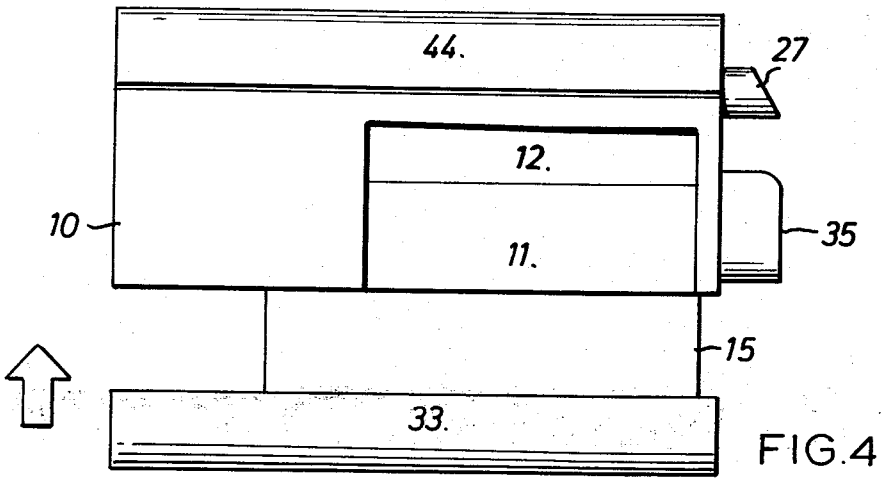
FIG. 4 is a plan view of the cigarette making machine of FIG. 1 with the tobacco compressor in the filling position.

A transversely movable retaining member 35 is lubricated in that it has a semi-cylindrical face 36 terminating in a pair of spaced arms conforming to the outer face of the nozzle 27. Retaining member 35 has a fixing lug 37 which slides in the slot 26 and is a snap fit in the hole 34 in the side face of the compression member 15. The member 35 moves with the compression member 15 and the limits of travel of the lug 37 in the groove 26 define the limits of movement of the compression member. At a filling position shown in FIGS. 2, 3 and 4 the lug 37 is at the left hand end of slot 26 (as seen in FIG. 2) and the front end face 16 of the compression member is spaced from the complementary semi-cylindrical face of the groove in the body to define the tobacco receiving chamber 13. At the fully compressed position (seen in FIGS. 7 and 8) the lug 37 is at the right hand end of the slot 26 and the semi-cylindrical faces of the body and of the compression member abut to define a cylindrical cavity 52 (FIG. 7) for a plug of compressed tobacco.

A metal tobacco spoon 40 is a sliding fit within the tobacco receiving chamber 13 and bears against the semi-cylindrical end face in the groove in the body 10. It has at its rear end a longitudinal slot 41. A cylindrical tobacco ejector plug 42 having transverse slots 43 and **43*a* may be fitted into the rear of the tobacco spoon. An injection handle 44 of semi-circular external profile is arranged to slide over the land formed on the second side edge of the body about the slit 18, and from its inner face project radial flanges 45, 45*a* respectively engageable in the slots 19, 19*a* in the body. The rear end of the injection handle is formed with a slot 46 through which may be passed a shank 47 of a retaining clip 48 having feet 49 and 49*a***.

The parts described above may be assembled easily and conveniently into the cigarette making machine. The tobacco spoon 40 is placed in the compression chamber 13 with the slot 41 aligned with the slot 18. The plug 42 is placed against the tobacco spoon with the slots 43 and **43*a* in alignment with the slot 41. The flanges 45 and 45*a* of the handle 44 are engaged with respective slots 19 and 19*a* on the body and the handle is slid rearwardly until the slot 46 is in alignment with the slot 41, after which the retaining clip 48 is inserted through the slot 46 with its shank 47 projecting through the slot 18 into the slot 41 and with its feet 49 and 49*a* snap-fitting into respective slots 43 and 43*a* of the plug 42. Accordingly the handle, tobacco spoon and ejector plug are slidingly secured to the body with the handle movable longitudinally between extended and retracted positions respectively defined by the front and back ends of the slot 18 and with the tobacco spoon moving with the handle 46 between an extended position in which it projects through the spigot 27 and a retracted position in which it is wholly within the tobacco compression chamber behind the slot 18. The plug 42 acts as a ram to force tobacco from the compression chamber through spigot 27 as the handle 44 is moved. The handle 33 is snap fitted to the compression member 15 after which the compression member 15 is inserted into the compression chamber 13. The retaining lug 37 on the retaining member 35 is inserted through the slot 26 and is snap fitted into in the hole 34 in the front side edge of the compression member 15**.

Figure 5:
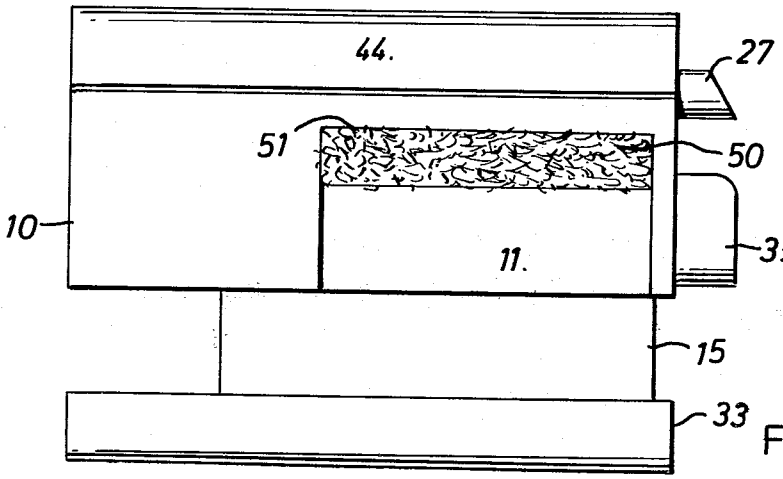
FIG. 5 is a plan view similar to FIG. 4 but with tobacco present in the tobacco reception area.
Figure 6:
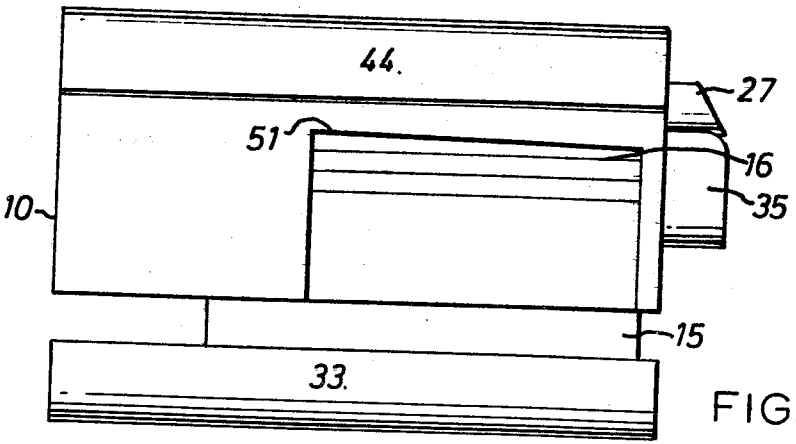
FIG. 6 is a plan view similar to FIG. 5 but with the tobacco compressor part way through its travel.

The operation of the cigarette making machine may be seen with reference to FIGS. 5 to 8. The handle 32 is operated to bring the compression member 15 to the filling position in which it has moved behind the slot 12 so that the tobacco receiving chamber 13 communicates with the tobacco receiving ledge 11. Retaining member 35 is moved transversely away from nozzle 27. The handle 44 is in the retracted position in which tobacco spoon 40 is wholly within the body 10. Tobacco 50 is fed through slot 12 into the compression chamber 13. An open end of preformed empty paper cigarette tube (which may be provided with a filter tip) is fitted over the nozzle 27. Handle 32 is then operated to compress the tobacco in the compression chamber. It should be appreciated that handle 44, when in its retracted position as shown in FIG. 5, cooperates with handle 33 to define a transversely collapsible fist-grip assembly for enabling compression of the charge of tobacco with a single hand. An intermediate stage in the compression is shown in FIG. 6 but the tobacco is not shown for the sake of clarity. The leading edge 16 of the compression member 15 moves towards the back edge 51 of the slot 12 which is directed obliquely to provide, as previously stated, a scissor-like cutting action. When the handle 32 has travelled fully towards the compression position the cigarette tube is sandwiched between and retained by the retaining member 35 which slidably engages at least the sides of nozzle 27 to thereby securely capture the tube.

Figure 7:
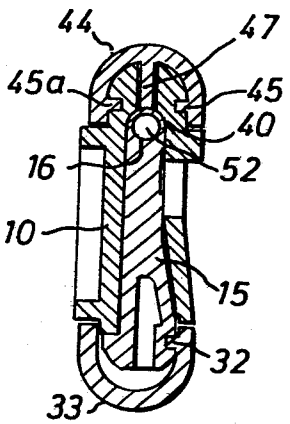
FIG. 7 is a transverse sectional view through the machine of FIG. 1 with the tobacco compressor in the compression position.
Figure 8:
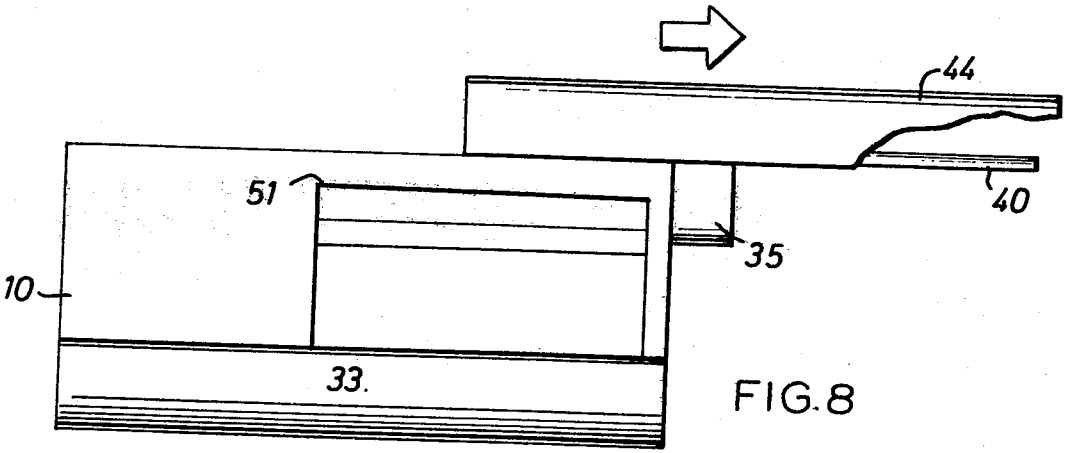
FIG. 8 is a plan view of the machine with the injector slide in its extended position.

FIG. 7 shows the condition of the machine when compression member 15 when moved to the fully compressed position in which the leading end face 16 of the compression member is positioned adjacent the tobacco spoon 40. In FIG. 8 the compression member is in the fully compressed position and the handle 44 is being moved longitudinally to extend the tobacco spoon 40 through the spigot 27 and introduce the plug of tobacco in cylindrical cavity 52 into the cigarette tube.

The tobacco spoon may be formed in metal or in a plastic material. The remaining components of the machine may be formed in plastic material by injection moulding. The machine of the invention has the advantages that it is of inherently simple construction and may be made compact and even of pocket size. It is inespensive and simple to assemble but it is reliable in operation, easy to use and requires relatively little effort on both the compression and the injection stroke. The scissor-like cutting action provides several advantages over previously known machines. It provides a more dependable severing action on strands of tobacco protruding from the compression chamber so that there is less interference with the injection stroke, less disturbance to the plug of tobacco during injection and hence the cigarette produced is often of better appearance than that normally obtained on an existing machine.

Various modifications may, of course, be made to the cigarette making machine described above without departing from the invention.

We claim:

1. A manually operated cigarette making machine comprising in combination:

an elongate body having an internal groove including a first semi-cylindrical face directed longitudinally of said body;

a compression member slidable in said groove and having a front end profiled to define a second semi-cylindrical face, and a first operating handle directly connected to said compression member for moving said compression member transversely between a first position in which said first and second semi-cylindrical faces are spaced apart to define with adjoining regions of said body a tobacco receiving chamber and a second position in which said semi-cylindrical faces abut to define a cavity for compressed tobacco;

a nozzle projecting from said body and communicating with said cavity for supporting a preformed cigarette tube;

means for ejecting a charge of compressed tobacco from said cavity through said nozzle into said cigarette tube;

portions of a top face of said body defining a tobacco insertion slot communicating with said tobacco receiving chamber when said compression member is in said first position; and means for exerting a scissor-like cutting action on strands of tobacco projecting from said tobacco receiving chamber into said slot, said cutting means comprising a top front edge of said compression member and a back edge of said tobacco insertion slot, said back edge being directed generally parallel to the axis of said cavity but at a small acute angle relative to the top front edge of said compression member so that said edge of said compression member slides past said angularly disposed back edge of said slot during travel of said compression member from said first to said second position thereby cleanly severing the projecting tobacco strands;

portions of the top face of the compression member behind the top front edge thereof being recessed to define a waste vent groove for reception of cut strands of tobacco.

2. A manually operated cigarette making machine comprising in combination:

a generally rectangular body having means defining an internal cavity opening to a first side thereof, extending towards a second opposite side thereof and having a first semi-cylindrical surface at its inner end;

a compression member having a second semi-cylindrical surface and slidable in said cavity transversely of said body between a first position in which said first and second surfaces are radially spaced apart and a second position in which said first and second surfaces together form a cylindrical space in which a charge of tobacco may be compressed into a plug;

means defining a slot in said body through which said charge of tobacco can be inserted into the space between said first and second surfaces when said compression member is in the first position;

a nozzle communicating with an end of said cylindrical space and adapted to receive the end of a preformed paper tube;

means for ejecting said plug of compressed tobacco from said cylindrical space through said nozzle into said paper tube;

a first handle directly connected to the compression member without any intermediate member and movable thereon solely in translation transversely of said body for actuation of said compression member between said first and second positions, said handle being disposed adjacent the first side of the body and directed parallel thereto;

a second handle having a length substantially equal to the longitudinal dimension of said body operatively connected to said ejecting means and mounted on the second side of the body for sliding movement longitudinally of said body between a retracted position in which said handle substantially overlies the second side of said body and an extended position in which said handle extends from an end of said body in the direction of said nozzle, movement of said second handle to its extended position causing the ejection of said plug of tobacco into said paper tube; and said first handle being cooperatively disposed with respect to said second handle in its retracted position to define transversely collapsible fist-grip means for enabling compression of the charge of tobacco by manual pressure in generally opposed directions transversely of the body by movement of the thumb toward the fingers of a single hand.

* * * * *